United States Patent [19]

Ohkouchi et al.

[11] 3,999,579

[45] Dec. 28, 1976

[54] WEFT EJECTION NOZZLE FOR WATER JET LOOMS

[75] Inventors: Tsuneyoshi Ohkouchi, Hamakita; Yuji Umebayashi, Hamamatsu, both of Japan

[73] Assignee: Enshu Limited, Japan

[22] Filed: Dec. 30, 1975

[21] Appl. No.: 645,368

[52] U.S. Cl. ..... 139/435; 28/1.4; 226/97

[51] Int. Cl.[2] ..... D03D 47/28

[58] Field of Search ..... 139/435; 226/7, 97; 28/1.4

[56] References Cited

UNITED STATES PATENTS

| | | | |
|---|---|---|---|
| 3,485,428 | 12/1969 | Jackson | 28/1.4 |
| 3,633,808 | 1/1972 | Svaty | 139/435 |
| 3,754,694 | 8/1973 | Reba | 226/97 |
| 3,863,822 | 2/1975 | Keldany | 139/435 |

*Primary Examiner*—Henry S. Jaudon

[57] ABSTRACT

A weft ejection nozzle for water jet looms is provided with a flow controller incorporated therein while embracing the nozzle main body in such an arrangement that the operating fluid from a given supply source is rendered to flow, in the first place, centripetally towards the periphery of the nozzle main body, to flow, in the second place, axially along the periphery of the nozzle main body, both being in the form of several flows separated from each other and being free of mutual interference, and to flow, finally, collectively and convergingly towards the weft ejection terminal of the nozzle, whereby the flow of fluid is so rectified as to entrain the weft for insertion into open sheds with increased propelling force.

15 Claims, 15 Drawing Figures

Fig. 5A
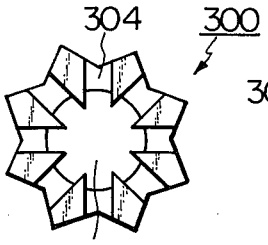
Fig. 5B
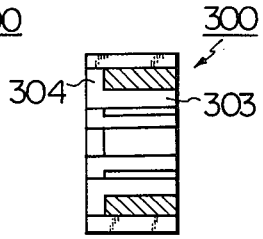
Fig. 5C
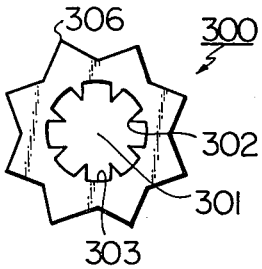
Fig. 6A
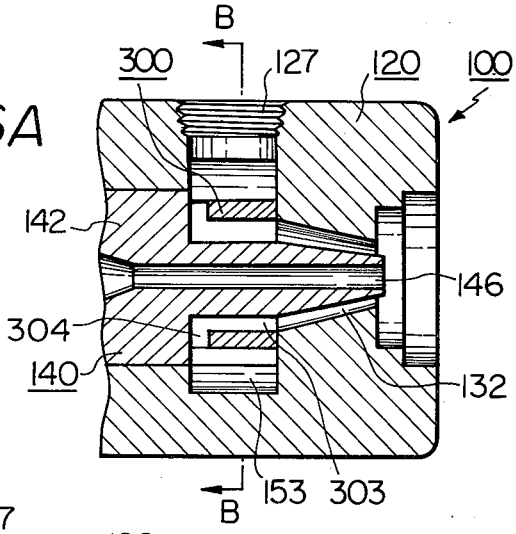
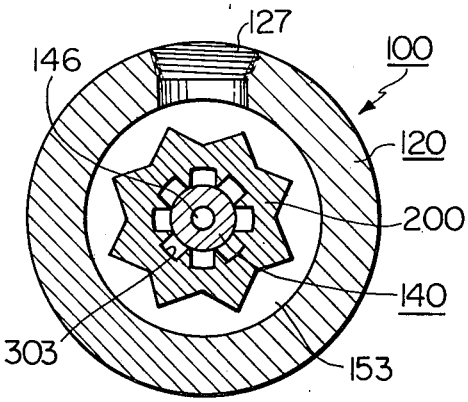
Fig. 6B Fig. 7
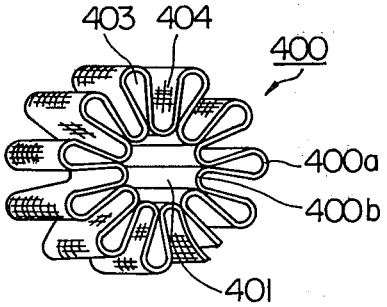
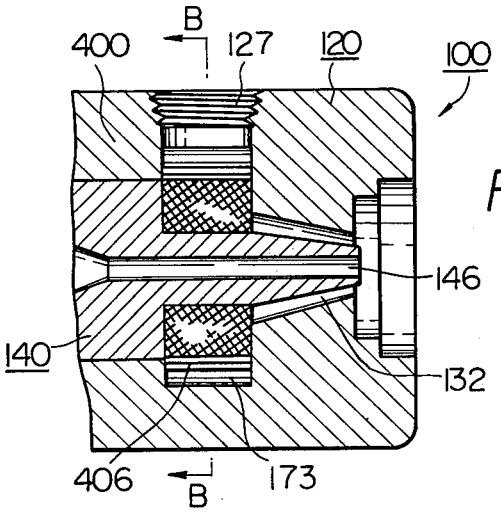
Fig. 8A
Fig. 8B
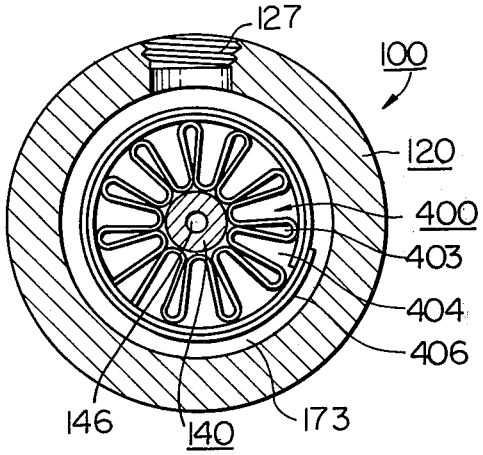

WEFT EJECTION NOZZLE FOR WATER JET LOOMS

BACKGROUND OF THE INVENTION

The present invention relates to an improved weft ejection nozzle for water jet looms, and more particularly relates to a flow controller of an improved construction and incorporated in the nozzle for inserting a weft into open sheds by entraining same in high speed water jet columns ejected therefrom on water jet looms.

The weaving condition on water jet looms is heavily dependent upon how well the operating fluid can be centripetally directed in order to fully encircle the weft in the water column and how well the operating fluid can be accelerated at the ejection terminal of the jet nozzle in order to entrain the weft with increased propelling force. In this connection, it is well known that smooth centripetal collection and acceleration of the operating fluid flow is seriously hindered by generating of vortical turbulence of the fluid flow during the travel of same from the entrance into the nozzle to the weft ejection terminal of the nozzle. In water jet nozzles of conventional construction, an axially elongated nozzle main body for supply of the weft is housed within a casing while leaving a cylindrical chamber therearound and the operating fluid under pressure is supplied in radial direction into the cylindrical chamber. As a result this forced radially directed supply of the operating fluid should naturally generate a vortical turbulence in the cylindrical chamber which moves towards the weft ejection terminal of the nozzle.

In order to minimize the harmful influence of the turbulence upon the weft insertion, it is required to mitigate the generation of the vortical turbulence of the operating fluid during its travel through the above-described cylindrical chamber.

One proposal has already been made in this sense, in which a thin cylindrical piece having a number of radially aligned through holes is set within the cylindrical chamber while spatially embracing the nozzle main body. With this arrangement, it is intended that the perforated construction of the cylindrical piece should function as a rectifier lattice for the operating fluid.

In practice, however, the operating fluid once introduced into the nozzle under high pressure forms a violent vortical turbulence within the space in the chamber around the cylindrical piece and, due to the small thickness of the piece, the flow of fluid passing through the piece holes cannot be rectified sufficiently. As a result, the fluid flows spouting radially out of the piece holes should again form a vortical turburence within the space of the chamber inwardly of the cylindrical piece. This naturally has a harmful influence upon smooth weft insertion. In addition, the kinetic energy originally possessed by the operating fluid may be considerably reduced through collision with the cylindrical piece, the rectifier lattice, which naturally causes reduced propelling force of the jet water column. So, it is known that the proposal of this tye should end in reduced propelling effect with insufficient flow rectifying effect only.

Another proposal has already been made in the above-described sense also, in which a cylindrical piece having a number of axial flow passages is set within the cylindrical chamber of the casing while being snugly inserted over the nozzle main body. With this arrangement, it is intended that the construction with the axial passages should function as a rectifier lattice for the operating fluid.

In practice, however, although this arrangement may assure some flow rectifying effect, it does not serve to centripetally collect the flow of the fluid. Further, in areas of the cylindrical chamber upstream and downstream of the cylindrical piece, some vortical turburences may occur.

BRIEF DESCRIPTION OF THE INVENTION

It is a primary object of the present invention to provide an improved weft ejection nozzle for water jet looms capable of excellently collecting the operating fluid centripetally in order to fully encircle the weft with the water jet column.

It is another object of the present invention to provide an improved weft ejection nozzle for water jet looms capable of excellently accelerating the operating fluid at the ejection terminal of the jet nozzle in order to entrain the weft with increased propelling force.

In accordance with the present invention, the weft ejection nozzle is comprised of a nozzle main body, a casing and a flow controller. The nozzle main body is provided with a stem forwardly tapering and merging into a converging nose and a weft passage formed axially through the nozzle main body. The nozzle main body is coaxially and fixedly encased within a casing while leaving a conically cylindrical flow passage around the nose thereof and, further, a cylindrical chamber around the stem thereof which is connected at its upstream end to a given supply source of operating fluid. The weft passage and the flow passage both open in a weft ejection outlet formed in the forward terminal of the casing. The flow controller is inserted into the cylindrical chamber being snugly carried by the stem of the nozzle main body in such an arrangement that the operating fluid passes through the flow controller during its travel from the cylindrical chamber to the flow passage. Further, the flow controller is provided with a construction capable of rectifying the flow of the operating fluid during the travel.

BRIEF DESCRIPTION OF THE DRAWINGS

FIG. 7 is a perspective plan view of a third embodiment of the flow controller used for the weft ejection nozzle in FIG. 2, and FIGS. 8A and 8B are a side sectional and a transverse cross sectional plan views, respectively of the weft ejection nozzle with the flow controller in FIG. 7.

DETAILED DESCRIPTION OF THE INVENTION

Figure 1:
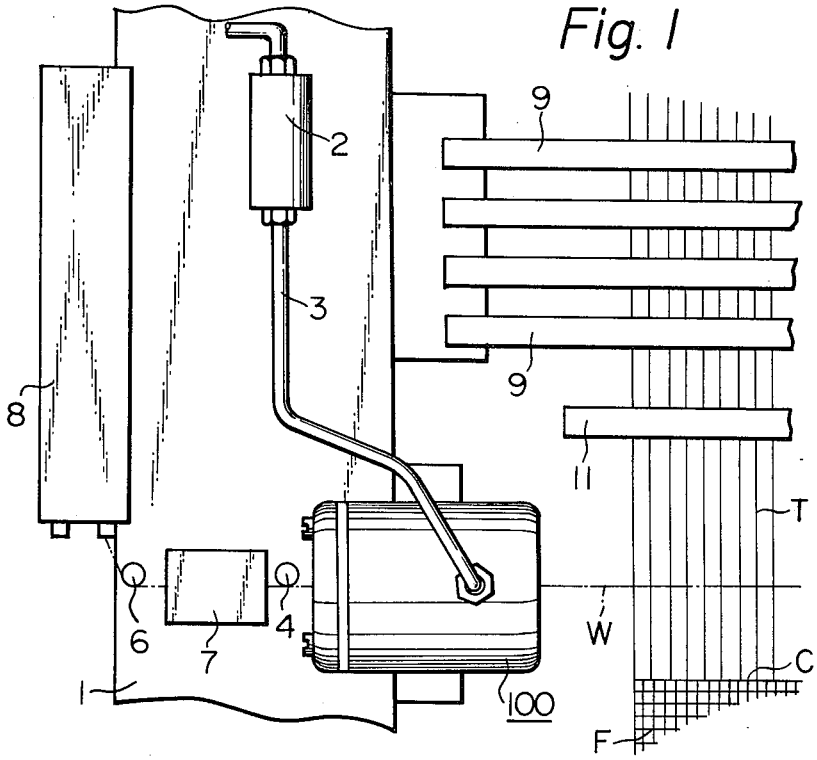
FIG. 1 is a top plan view of the weft ejection nozzle in accordance with the present invention and its related parts on a water jet loom.

The arrangement relating to the weft ejection nozzle in accordance with the present invention is shown in FIG. 1, in which the weft ejection nozzle 100 is fixed to the framework 1 of the loom at a position spaced laterally from the warp sheet T and somewhat rearwards of the cloth-fell C of the fabric F. The ejection nozzle 100 is connected to a given supply source 2 of the operating fluid, such as water, via a conduit pipe 3 and, further, is upstreamly accompanied with guide rollers 4 and 6, a gripper mechanism 7 and a weft reservoir 8.

The warp sheet T is driven for shedding motion by healds 9 and the weft W delivered from the reservoir 8 via the gripper mechanism 7 is inserted into the open shed (formed by the warp sheet T) by the nozzle 100 while being entrained in the jet fluid column ejected from the nozzle 100. After insertion, the weft W is beaten against the cloth-fell C of the fabric F by a reed 11 carried on a rocking lathe which is not shown for purposes of simplicity. It will be well understood that the axial direction of the nozzle 100 crosses the warp direction substantially at a right angle.

The internal construction of the weft ejection nozzle 100 in accordance with the present invention is shown in detail in FIG. 2 in which the later described flow controller is omitted for purposes of simplicity. The nozzle 100 is comprised of an internally hollow casing 120, a nozzle main body 140 incorporated within the casing 120 and a flow controller (not shown) which will be explained later in detail.

From the weft input side to the weft output side, the casing 120 is internally provided with a small diameter hole 121, a large diameter hole 122, a forwardly converging hole 123, a small diameter outlet 124 and a terminal outlet 126 of a larger diameter, all being in axial alignment and communication to each other. A radially aligned conduit 127 is formed through the wall of the large diameter hole 123 for establishing a communication of the interior of the casing 120 with the conduit pipe 3 shown in FIG. 1.

In the same order, the nozzle main body 140 is comprised of a rear end flange 141, a large diameter stem 142, a small diameter stem 143 and a forwardly converging tapered nose 144. A weft passage 146 is formed axially through the entire portion of the nozzle main body 140. The nozzle main body 140 is fixed to the rear end of the casing 120 at its rear end flange 141 by set screws 101 with a packing 102 being sandwiched between the two for the purpose of water tight sealing.

The dimensions of the casing 120 and the nozzle main body 140 are designed in relation to each other as follows; The diameter of the small hole 121 of the casing 120 is so designed as to snugly accommodate the large diameter stem 142 of the nozzle main body 140; the diameter of the large hole 122 in casing 120 is larger than the outer diameter of the small diameter stem 143 of the nozzle main body 140 by an amount sufficient to provide a hollow annular chamber 131 around the small diameter stem 143 and a conical shaped cylindrical flow passage 132 should be formed around the converging nose 144 over the entire length thereof. The front end of the nose 144 should be slightly exposed in the small diameter outlet 124. As is clear from the following explanation, the annular chamber 131 is used for accommodating the latter described flow controller whereas the conical shaped flow passage 132 is used for conducting the operating fluid from the flow controller to the vicinity of the outlet of the weft passage in such a fashion that the operating fluid emitted from the flow passage 132 forms a fluid column in which the weft W from the passage 146 is completely wrapped and entrained.

Figure 2:
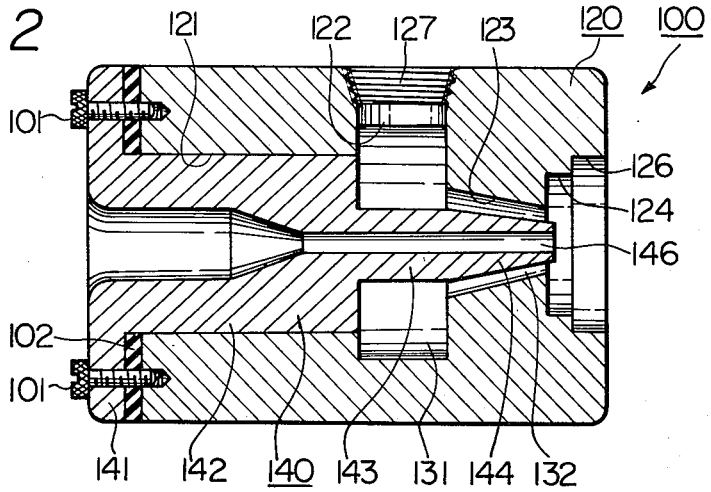
FIG. 2 is a side sectional plan view of the weft ejection nozzle in FIG. 1 in which the flow controller has been omitted for purposes of simplicity, FIGS. 3A to 3C respectively show rear end face, side sectional and front end face plan views of the first embodiment of the flow controller used with the weft ejection nozzle in FIG. 2, FIGS. 4A and 4B respectively show side sectional and transverse cross sectional plan views of the weft ejection nozzle employed with the flow controller in FIGS. 3A to 3C, FIGS. 5A to 5C respectively show rear end face, side sectional and a front end face plan views of a second embodiment of the flow controller used for the weft ejection nozzle in FIG. 2, FIGS. 6A and 6B are a side sectional and a transverse cross sectional plan views, respectively of the weft ejection nozzle used with the flow controller in FIGS. 5A to 5C.
Figure 3A:
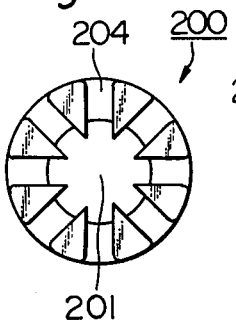
Figure 3B:
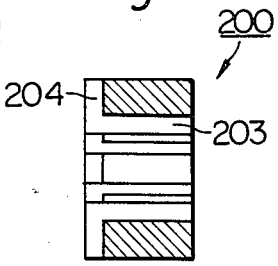
Figure 3C:
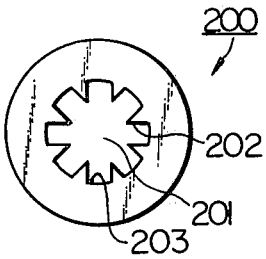

One embodiment of the flow controller to be used in combination with the arrangement shown in FIG. 2 is illustrated in FIGS. 3A through 3C. In the case of this embodiment, the flow controller 200 is takes the form of a cylindrical unit having an axially aligned center hole 201 which is defined by edges 202 of a plurality of axially elongated peripheral grooves 203. The flow controller 200 is further provided, in its one end surface, with a plurality of radially aligned grooves 204, each being in communication with a corresponding axial groove 203. The outer diameter of the flow controller 200 is smaller than the outer diameter of the annular chamber 131 in the casing 120 whereas the diameter of a circle defined by the edges 202 of the grooves 203 should be so designed that the stem 143 of the nozzle main body 140 is received within the center hole 201 being snugly engaged by the edges 202 of the axial grooves 203. The axial length of the flow controller 200 should be substantially equal to that of the chamber 131. (see FIG. 2)

Figure 4A:
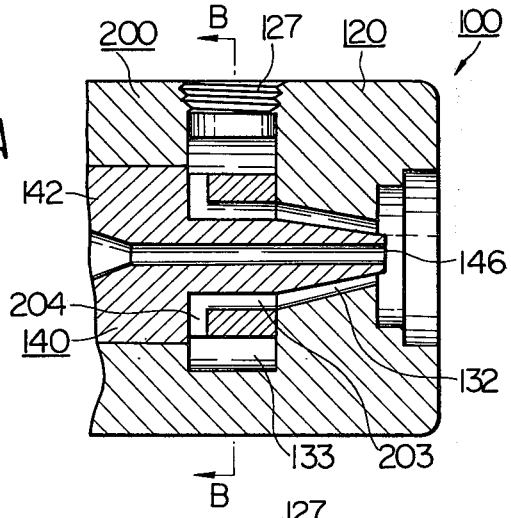
Figure 4B:
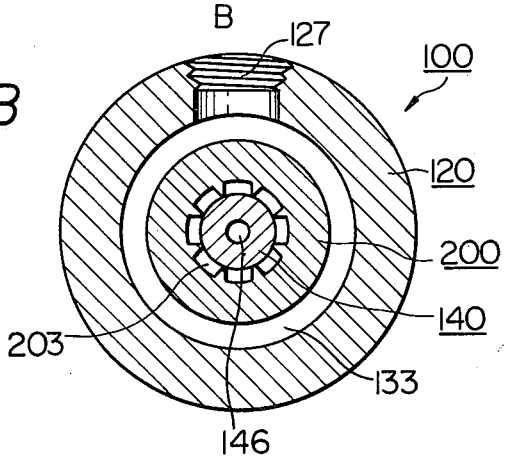

As shown in FIGS. 4A and 4B, the flow controller 200 is placed in the chamber 131 of the casing 120 with its radial grooves 204 confronting the large diameter stem 142 of the nozzle main body 140. In this assembled disposition, a hollow annular chamber 133 is formed around the flow controller 200. Thus, a communication is established from the conduit pipe 3 to the vicinity of the opening of the weft passage 146 by the radial conduit 127 in the casing 120, the hollow annular chamber 133 around the flow controller 200, the grooves 204 and 203 of the flow controller 200 and the conical shaped hollow flow passage 132 around the converged nose 144 of the nozzle main body 140.

With the above-described construction of the weft ejection nozzle in accordance with the present invention, the operating fluid supplied under pressure into the radial conduit 127 of the casing 120 initially flows into the cylindrical chamber 133 and spreads around the entire periphery of the flow controller 200. The operating fluid so filling the cylindrical chamber 133 then flows centripetally (i.e. radially inward) along the radial grooves 204 of the flow controller 200 and into the axially aligned grooves 204.

During this centripetal flow of the pressured fluid through the radial grooves 204, the radial grooves 204 act on the fluid as flow rectifier lattices and effectively minimize the vortex turbulence of the flow which would otherwise occur and hinder for the fluid to wholly wrap and stably entrain the weft with strong propelling force. Being guided by the axial grooves 203, the fluid moves towards the conically cylindrical passage 132 being free of vortex turbulence generation as the axial flows of the fluid through the flow controller 200 are completely separated from each other so as to allow no interference between the flows.

The flow of the fluid issuing out of the axial grooves 203 merge in the passage 132 and, due to the convergence of the passage 132, the fluid gathers in the region of the tip end of the nose 144 forming a strong jet fluid column which completely encircles the weft issuing from the passage 146 in order to stably entrain the same for successful weft insertion at an escalated propelling force.

Another embodiment of the flow controller to be used in combination with the arrangement shown in FIG. 2 is illustrated in FIGS. 5A through 5C. In the case of this embodiment, the flow controller 300 takes the form of a unit having a star-shaped transverse cross sectional profile with an axially alligned center hole 301 which is defined by the inner edges 302 of a plurality of axially elongated peripheral grooves 303. The flow controller 300 is further provided, in its one end surface, with a plurality of radially aligned grooves 304, each being in communication with corresponding axial grooves 303. The diameter of a circle defined by outer peripheral edges 306 of the flow controller 300 is smaller than the outer diameter of the chamber 131 in the casing 120 whereas the diameter of a circle defined by the edges 302 of the grooves 303 is preferably designed so that the stem 143 of the nozzle main body 140 is received within the center hole 301 being snugly engaged by the edges 302 of the axial grooves 303. The length of the flow controller 300 should be substantially equal to that of the chamber 131 (see FIG. 2).

As shown in FIGS. 6A and 6B, the flow controller 300 is placed in the chamber 131 of the casing 120 with its radial grooves 304 confronting the large diameter stem 142 of the nozzle main body 140. In this assembled disposition, a pseudo-cylindrical hollow chamber 153 is formed around the flow controller 300. Thus, communication is established from the conduit pipe 3 to the vicinity of the opening of the weft passage 146 by the radial conduit 127 in the casing 120, the pseudo-cylindrical chamber 153 around the flow controller 300, the grooves 304 and 303 of the flow controller 300 and the conical shaped hollow flow passage 132 around the converged nose 144 of the nozzle main body 140.

With the above-described construction of the current embodiment, control of the fluid flow is carried out in a manner basically the same as that described in connection with the foregoing embodiment. However, the indented construction of the outer periphery of the flow controller 300 of this embodiment assures higher deterrence against generation of vortex turbulence in the chamber 153 than that in the case of the foregoing embodiment.

That is, the operating fluid supplied under pressure into the radial conduit 127 of the casing 120 initially flows into the pseudo-cylindrical chamber 153 and spreads over the entire periphery of the flow controller 300. As described above, the presence of indentations on the periphery of the flow controller 300 effectively hinders possible generation of vortex turbulence during this spreading procedure. The operating fluid so filling the chamber 153 then flows centripetally into the axial grooves 303 of the flow controller 300 through the radial grooves 304.

During this centripetal flow of the pressured fluid through the radial grooves 304, the radial grooves 304 act on the fluid as flow rectifier lattices and effectively minimize the vortex turbulence of the flow which would otherwise occur and thus hinder the fluid from wholly wrapping and stably entraining the weft with a strong propelling force. Being guided by the axial grooves 303, the fluid moves towards the conical shaped passage 132 being free of vortex turbulence generation as the axial flows of the fluid through the flow controller 300 are completely separated from each other so as to prevent interference between the flows in each groove.

The flows of the fluid emitted from the axial grooves 303 merge in the passage 132 and, due to the convergence of the passage 132, the fluid is gathered at the tip end of the nose 144 in order to form a strong jet fluid column which completely wraps around the weft issuing from the passage 146 and stably entrains the same for successful weft insertion with escalated propelling force.

In the case of the foregoing two embodiments, it is preferred that the depth of the axial grooves 203 or 303 should not exceed the thickness of the conically cylindrical passage 132 so that the fluid in the axial grooves 203 or 303 can smoothly flow into the passage 132. Otherwise, the fluid will partly collide against an annular step formed at the junction of the grooves 203 or 303 with the passage 132 and turbulence may occur.

The other embodiment of the flow controller to be used in combination with the arrangement shown in FIG. 2 is illustrated in FIG. 7. In the case of this embodiment, the flow controller 400 is given in the form of an unit made up of a relatively rigid mesh sheet such as a wire cloth. The flow controller 400 made of the mesh sheet has a plurality of outwardly extending convex portions **400*a* of similar transverse cross sectional profile and a plurality of inwardly extending concave portions 400*b* of similar transverse cross sectional profile in such an arrangement that each concave portion 400*b* intervenes between a pair of neighboring convex portions 400*a*. Preferably, the portions 400*a* and 400*b* are respectively formed in symmetric relationships to each other with respect to the center of a circle defined by the outermost surfaces of the convex portions 400*a*. The inner surfaces of the concave portions 400*b* confine an axial center hole 401**.

It will be well understood that the axial center hole 401 of this embodiment corresponds to the axial center holes 201 and 301 of the foregoing embodiments, spaces 403 defined by the convex portions **400*a* correspond to the axial grooves 203 and 303 and spaces 404 defined by the concave portions 400*b* correspond to the radial grooves 204 and 304, respectively. For purposes of simplicity, the spaces 403 will hereinafter be referred to as "the axial spaces" whereas the spaces 404** will hereinafter be referred to as "the radial spaces."

The diameter of the circle defined by the outermost surfaces of the convex portions **400*a* of the flow controller 400 is smaller than the outer diameter of the chamber 131 in the casing 120 whereas the diameter of a circle defined by innermost surfaces of the concave portions 400*b* of the flow controller 400 is preferably designed so that the stem 143 of the nozzle main body 140 is received within the center hole 301 being snugly engaged by the innermost ends of the concave portions 400*b*. The axial length of the flow controller 400 should be substantially equal to that of the chamber 131**. (see FIG. 2)

As shown in FIGS. 8A and 8B, the flow controller 400 of this embodiment is placed in the chamber 131 of the casing 120 being encircled by an additional mesh sheet 406, which is made of a relatively rigid material such as a wire cloth. In this assembled disposition, a pseudo-cylindrical hollow chamber 173 is formed around the flow controller 400. Thus a communication is established from the conduit pipe 3 to the vicinity of the opening of the weft passage 146 by the radial conduit 127 in the casing 120, the pseudo-cylindrical chamber 173 around the flow controller 400, the spaces 404 and 403 of the flow controller 400 and the conical shaped flow passage 132 around the converged nose 144 of the nozzle main body 140.

With the above-described construction of the current embodiment, control of the fluid flow is carried out in a manner basically similar to that described in connection with the preceding embodiment shown in FIGS. 5A through 5C. That is, indentations formed on the outer surface of the flow controller 400 assures excellent deterrence against generation of vortex turbulence in the chamber 173, the radial spaces 404 function as flow rectifier lattices and the axial spaces 403 prevent interference between the fluid flows through the flow controller 400. In addition to these common merits, the flow controller 400 of this embodiment is far superior to those of the foregoing embodiments that the mesh constructions of the sheets 400 and 406 provide excellent rectifier lattices for the fluid to be processed.

The operating fluid supplied under pressure into the radial conduit 127 of the casing 120 firstly flows into the pseudo-cylindrical chamber 173 and spreads over the entire periphery of the mesh sheet 406 encircling the flow controller 400. The operating fluid so filling the chamber 173 then flows passing through the mesh sheet 406, thereby the fluid flow being rectified by the meshes of the sheet 406. In this embodiment also, the presence of the indentations on the periphery of the flow controller 400 effectively hinders possible generation of vortex turbulence of the fluid.

After passing through the mesh sheet 406, the fluid flows centripetally through the radial spaces 404 into the axial spaces 403. During this centripetal flow of the pressured fluid, the radial spaces 404 act on the fluid as flow rectifier lattices and effectively minimize the vortex turbulence of the flow which should otherwise occur and hinder for the fluid to wholly wrap and stably entrain the weft with a strong propelling force. In addition, during the process of fluid transfer from the radial space 404 to the axial space 403, the grid mesh of the sheet acts on the fluid an miniature flow rectifier lattices.

Being guided by the axial spaces 403, the fluid moves towards the conically cylindrical passage 132 being free of vortex turbulence generation as the axial flows of the fluid through the flow controller 400 are completely separated from each other so as to allow substantially no interference between the flows.

The flows of the fluid issuing out of the axial spaces 403 merge in the passage 132 and, due to the convergence of the passage 132, the fluid is gathered to the tip end of the nose 144 in order to form a strong jet fluid column which completely surrounds the weft issuing from the passage 146 and stably entrain the same for successful weft insertion with high propelling force.

As is clear from the foregoing description, the following advantages can be obtained through employment of the present invention.

a. As the flow controller has an internal construction which brings about high flow rectifying effect, generation of vortex turbulence is effectively minimized and this results in formation of jet fluid column which completely surrounds the weft and stably entrains same for weft insertion with high propelling force.

b. As the flows of fluid through the flow controller are completely separated from each other, generation of vortex turbulence to be caused by interference between flows is well prevented.

c. When the flow controller is provided with outer peripheral indentations, generation of vortex turbulence is further restrained.

d. When the flow controller is made of a configured mesh sheet, the meshes provide miniature rectifier lattices and the flow of the fluid can be further rectified.

We claim:

1. An improved weft ejection nozzle for water jet looms comprising, in combination, a nozzle main body having a stem forwardly merging into a converging tapered nose and an axial weft passage extending through said nozzle main body, a casing having an opening coaxially and fixedly encasing said nozzle body while leaving a conically shaped hollow cylindrical flow passage around said nose of said nozzle main body and a cylindrical hollow chamber around said stem of said nozzle main body which is adapted to have its upstream end connected to a supply source of operating fluid, said weft passage and said flow passage opening in a weft ejection outlet formed in the forward terminal of said casing, and an annular shaped flow controller positioned within said cylindrical chamber being snugly engaged and carried by the stem of said nozzle main body and being arranged such that said operating fluid passes therethrough during its travel from said cylindrical chamber to said flow passage, said flow controller being provided with a construction capable of rectifying the flow of said operating unit during said travel and thereby avoid the occurrence of vortex turbulence in said nozzle.

2. The nozzle as claimed in claim 1 in which the axial length of said flow controller is substantially equal to that of said cylindrical hollow chamber.

3. The nozzle of claim 1 in which said flow controller is an axially elongated member having an axial center hole for coupling with said stem of said nozzle main body, a plurality of mutually separated radial fluid passages outwardly terminating in said cylindrical chamber and a plurality of mutually separated axial fluid passages formed in parallel to the axis of said center hole, the upstream ends of said axial fluid passages communicating with said radial fluid passages and the downstream ends communicating with the fluid passage formed around said nose of said nozzle main body.

4. The nozzle as claimed in claim 3 in which said flow controller further has axially extending indentations formed on the outer peripheral surface thereof.

5. The nozzle as claimed in claim 3 in which said axially elongated unit has, as said radial fluid passages, a plurality of mutually separated radial grooves formed in one side end surface of said unit opposite to said flow passage around said nose of said nozzle main body and, as said axial fluid passages, a plurality of mutually separated axial grooves formed in the peripheral wall defining said center hole, each being upstreamly connected to corresponding one of said radial grooves.

6. The nozzle as claimed in claim 5 in which the diameter of a circle defined by edges of said axial grooves is substantially equal to that of said stem of said nozzle main body.

7. The nozzle as claimed in claim 5 in which the depth of said axial grooves is equal to or smaller than the thickness of said flow passage around said nose of said nozzle main body at the entrance of the latter.

8. The nozzle as claimed in claim 7 in which the depth of said axial grooves is equal or larger than the thickness of said flow passage around said nose of said nozzle main body at the exit of the latter.

9. The nozzle as claimed in claim 5 in which said unit is provided with a circular transverse cross sectional outer profile.

10. The nozzle as claimed in claim 5 in which said unit is provided with a star-shaped transverse cross sectional profile.

11. The nozzle as claimed in claim 3 in which said axially elongated unit comprises a figured mesh sheet having a plurality of outwardly extending convex curved portions and a plurality of inwardly extending convex curved portions each of which intervenes a pair of neighboring convex curved portions, said concave curved portions defining radial spaces operating as said radial fluid passages, said convex portions defining axial fluid passages and innermost end surfaces of said concave portions defining said center hole.

12. The nozzle as claimed as claim 11 in which the diameter of a circle defined by said innermost surfaces of said concave portions is substantially equal to that of said stem of said nozzle main body.

13. The nozzle as claimed in claim 11 in which said mesh sheet is made of a wire cloth.

14. The nozzle as claimed in claim 11 further comprising an additional mesh sheet wound around said figured mesh sheet.

15. The nozzle as claimed in claim 14 in which said additional mesh sheet is made of a wire cloth.

* * * * *